US009180694B2

(12) United States Patent
Yoshino et al.

(10) Patent No.: US 9,180,694 B2
(45) Date of Patent: Nov. 10, 2015

(54) RECORDING APPARATUS

(71) Applicant: SEIKO EPSON CORPORATION, Tokyo (JP)

(72) Inventors: Satoshi Yoshino, Shiojiri (JP); Kensuke Tamai, Shirojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/543,336

(22) Filed: Nov. 17, 2014

(65) Prior Publication Data

US 2015/0165791 A1 Jun. 18, 2015

(30) Foreign Application Priority Data

Dec. 12, 2013 (JP) ..... 2013-256729

(51) Int. Cl.
*B41J 11/02* (2006.01)
*B41J 11/00* (2006.01)

(52) U.S. Cl.
CPC ..... *B41J 11/02* (2013.01); *B41J 11/0085* (2013.01)

(58) Field of Classification Search
CPC .. B41J 11/006; B41J 11/0085; G03F 7/70716
See application file for complete search history.

(56) References Cited

U.S. PATENT DOCUMENTS

| | | | | |
|---|---|---|---|---|
| 4,611,939 | A * | 9/1986 | Fujiwara | 400/637 |
| 6,236,422 | B1 * | 5/2001 | Nagahata et al. | 347/200 |
| 6,317,150 | B1 * | 11/2001 | Ono et al. | 347/200 |
| 6,460,990 | B2 * | 10/2002 | Yraceburu et al. | 347/102 |
| 6,542,224 | B2 * | 4/2003 | Ackerman et al. | 355/72 |
| 7,365,762 | B2 * | 4/2008 | Montagutelli | 347/222 |
| 2002/0109760 | A1 * | 8/2002 | Miyazawa et al. | 347/86 |

FOREIGN PATENT DOCUMENTS

| | | |
|---|---|---|
| JP | 2010-195540 | 9/2010 |
| JP | 2012-025082 | 2/2012 |

* cited by examiner

*Primary Examiner* — Stephen Meier
*Assistant Examiner* — John P Zimmermann
(74) *Attorney, Agent, or Firm* — Workman Nydegger

(57) ABSTRACT

A recording apparatus includes a recording head that performs recording on a recording medium, a medium support member that is disposed at a position where the medium support member can face the recording head and supports the recording medium, and a reinforcing member that is attached below the medium support member and has a greater rigidity than the medium support member. The medium support member includes a rigidity reduction unit that reduces the rigidity of the medium support member in a direction intersecting a transport direction of the recording medium.

15 Claims, 11 Drawing Sheets

RECORDING APPARATUS

BACKGROUND

1. Technical Field

The present invention relates to a recording apparatus that performs recording on a recording medium.

In the present application, types of the recording apparatus include a serial printer that performs recording while a recording head moves in a predetermined direction; a line printer in which a recording head does not move; and a copy machine, a facsimile, and the like that have functions of the above printers.

2. Related Art

A recording apparatus that includes a medium support unit and a base body unit is widely used in the related art (JP-A-2012-25082). The medium support unit supports a recording medium in an area where recording is performed by a recording head. The base body unit supports both end portions of the medium support unit in a direction intersecting the transport direction of the recording medium.

The medium support unit (hereinafter, referred to as "platen") is attached to the base body unit (hereinafter, referred to as "base") by a vis in the recording apparatus disclosed in JP-A-2012-25082. The recording apparatus is configured to be capable of changing the deflection of a surface of the platen where the recording medium is supported depending on the fastening state of the vis.

The height of a bearing surface on which the vis abuts in the platen is formed differently in the rotation direction of the vis in the recording apparatus. That is, the bearing surface is configured of an abutment surface on which the vis abuts and a non-abutment surface. A force that presses down the platen occurs in the abutment surface, and a repulsive force from the platen occurs in the non-abutment surface when the vis is fastened on the platen. The forces that occur in the abutment surface and the non-abutment surface negate each other. Accordingly, deflection that occurs on the support surface of the platen can be controlled. Therefore, deflection of the platen can reside within an allowable range by adjusting the fastening state of the vis.

Here, it is necessary to check how the platen is deflected when the abutment surface and the non-abutment surface are formed in the recording apparatus. In addition, the fastening state (fastening force and the like) of the vis with respect to the platen is necessary to be managed. Furthermore, the material of the platen may be changed because of measures for recording quality on the recording medium.

The platen may be deformed more than expected depending on the material of the platen when the material of the platen is changed. Accordingly, in the recording apparatus disclosed in JP-A-2012-25082, even adjusting the fastening state of the vis may not be able to resolve deformation of the platen when the platen is deformed more than expected. As a consequence, a gap between the platen and the recording head may not be uniform in the direction intersecting the transport direction of the recording medium. Therefore, recording quality on the recording medium may be degraded, and failure may occur in transporting the recording medium.

Another recording apparatus used in the related art has a configuration in which a platen is configured as a roller-shaped member, and a sheet guide auxiliary plate configured of one plate-shaped member is configured so as to abut on the platen (refer to JP-A-2010-195540). A recording medium is transported along a transport path between the platen and the sheet guide auxiliary plate in the recording apparatus disclosed in JP-A-2010-195540. The sheet guide auxiliary plate presses the recording medium against the platen to help the roller-shaped platen transport the recording medium when the recording medium is transported between the platen and the sheet guide auxiliary plate.

Furthermore, a plurality of slits are formed along the axis direction of the roller-shaped platen in the sheet guide auxiliary plate. The slits divide the upper end of the sheet guide auxiliary plate into a plurality of guide pieces. According to this configuration, a guide piece in contact with the recording medium and a guide piece at a position away from the transport position of the recording medium each independently abut on the platen when the recording medium is transported by the platen. As a consequence, inclination of the entire sheet guide auxiliary plate caused by the thickness of the recording medium can be resolved since the guide piece in contact with the recording medium is independently operated. Therefore, recording is stably performed since the inclination of the sheet guide auxiliary plate can be controlled by the slits without being affected by the thickness or the size of the recording medium.

However, when the roller-shaped platen is bent in a direction intersecting the axis line direction of the platen and is deformed, the sheet guide auxiliary plate is bent along the axis line direction along with the deformation of the platen. Therefore, deformation of the platen cannot be reduced. As a consequence, deformation of the platen may cause failure to occur in transporting the recording medium.

SUMMARY

An advantage of some aspects of the invention is to provide a recording apparatus that can suppress degradation of recording quality on a recording medium and reduce occurrence of failure in transporting the recording medium by reducing deformation of a medium support member.

According to an aspect of the invention, there is provided a recording apparatus including a recording head that performs recording on a recording medium, a medium support member that is disposed at a position where the medium support member can face the recording head and supports the recording medium, and a reinforcing member that is attached below the medium support member and has a greater rigidity than the medium support member, in which the medium support member has bendability to follow the reinforcing member in a direction intersecting a transport direction of the recording medium, and the medium support member includes a rigidity reduction unit that reduces the rigidity of the medium support member in a direction intersecting a transport direction of the recording medium.

In this case, the medium support member that supports the recording medium is attached to the reinforcing member that has a greater rigidity than the medium support member and has bendability to follow the reinforcing member in the direction intersecting the transport direction of the recording medium. Accordingly, the medium support member follows the reinforcing member in the intersecting direction even when the medium support member bends due to change in volume caused by environmental change such as temperature and humidity. Thus, the medium support member is dependent on the accuracy of the reinforcing member. Consequently, deformation of the medium support member can be suppressed on the transport path of the recording medium. Therefore, degradation of recording quality on the recording medium can be suppressed, and occurrence of failure in transporting the recording medium can be reduced. In addition, the medium support member includes a rigidity reduction unit that reduces the rigidity of the medium support member in the direction intersecting the transport direction of the recording medium. Accordingly, the medium support member follows the reinforcing member attached to the medium support member even when the medium support member bends due to change in volume caused by environmental change such as humidity since the rigidity reduction unit allows the rigidity of the medium support member to be smaller than that of the reinforcing member. Consequently, the medium support member is dependent on the accuracy of the reinforcing member, and the amount of deformation of the medium support member can be reduced. Therefore, degradation of recording quality on the recording medium can be suppressed, and occurrence of failure in transporting the recording medium can be reduced on the transport path of the recording medium.

It is preferable that the reinforcing member have a smaller thermal expansion coefficient than the medium support member, and the medium support member follow the reinforcing member in response to environmental change.

In this case, the reinforcing member has a smaller thermal expansion coefficient than the medium support member. Since the reinforcing member has a small thermal expansion coefficient, expansion of the reinforcing member can be suppressed greater than that of the medium support member when the temperature around the reinforcing member and the medium support member rises, and the reinforcing member and the medium support member thermally expand. As a consequence, the reinforcing member maintains the state thereof close to the state before expansion since the volume change before and after expansion is small. Accordingly, the medium support member that expands in response to the volume change follows the reinforcing member in the intersecting direction because of the bendability of the medium support member. Consequently, deformation of the medium support member can be suppressed on the transport path of the recording medium. Therefore, degradation of recording quality on the recording medium can be suppressed, and occurrence of failure in transporting the recording medium can be reduced.

Meanwhile, "environmental change" in this case indicates that temperature, humidity, and the like cause change in the volume of the medium support member and the reinforcing member.

It is preferable that the rigidity reduction unit include a slit that extends along the transport direction and is plurally disposed at an interval in the intersecting direction.

In this case, the rigidity reduction unit includes a slit that extends along the transport direction and is plurally disposed at an interval in the intersecting direction. Accordingly, the medium support member is likely to follow the shape of the reinforcing member in the intersecting direction since the medium support member curves at the part where the plurality of slits is disposed in the intersecting direction when the medium support member follows the reinforcing member. Consequently, deformation of the medium support member can be reduced since the medium support member follows the reinforcing member in the intersecting direction. Therefore, degradation of recording quality on the recording medium can be suppressed, and occurrence of failure in transporting the recording medium can be reduced on the transport path of the recording medium.

It is preferable that the slit be formed on at least one side of an upstream side and a downstream side of the transport direction.

In this case, accordingly, the medium support member is likely to follow the shape of the reinforcing member in the intersecting direction since the medium support member curves at the part where the plurality of slits is disposed in the intersecting direction when the medium support member follows the reinforcing member.

It is preferable that the medium support member include a plurality of holding units that holds the reinforcing member at intervals in the intersecting direction, and the holding unit be disposed to correspond to the position of the slit.

In this case, the plurality of holding units that holds the reinforcing member at intervals in the intersecting direction is arranged in the medium support member to correspond to the position of the slit. The medium support member is likely to curve at the part where the slit is disposed when the medium support member bends due to change in volume caused by environmental change such as humidity and the like. The part where the slit is disposed tends to bend in a direction separating from the reinforcing member. Accordingly, forming the holding unit in the medium support member to correspond to the position of the slit suppresses separation of the part where the slit is disposed from the reinforcing member when the medium support member curves at the part where the plurality of slits is disposed in the intersecting direction. As a consequence, the medium support member can securely follow the reinforcing member in the intersecting direction.

It is preferable that the holding unit include a hook that hooks the reinforcing member in the medium support member.

In this case, the reinforcing member can be easily attached to the medium support member, and the reinforcing member can be securely held in the medium support member since the holding unit includes the hook that hooks the reinforcing member in the medium support member.

It is preferable that the rigidity reduction unit include a groove that is plurally disposed in the medium support member.

In this case, the plurality of grooves is disposed in the medium support member as the rigidity reduction unit. Accordingly, the medium support member is likely to follow the reinforcing member since the rigidity of the medium support member can be reduced.

It is preferable that the medium support member be formed of a conductive resin.

In this case, the medium support member is formed of a conductive resin. The conductive resin, that is, a conductive material, for example, is effective for measures against attachment of paper dust, but the medium support member tends to be greatly deformed when the medium support member is formed of the conductive material. Regarding this, the rigidity reduction unit in this case is particularly effective for the medium support member that is formed of the conductive resin because the rigidity reduction unit decreases the rigidity of the medium support member so that the medium support member follows the reinforcing member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to the accompanying drawings. The same configuration in each embodiment will be given the same reference sign and will be described only in the initial embodiment; therefore, the description of the same configuration will be omitted in the subsequent embodiments.

Figure 1:
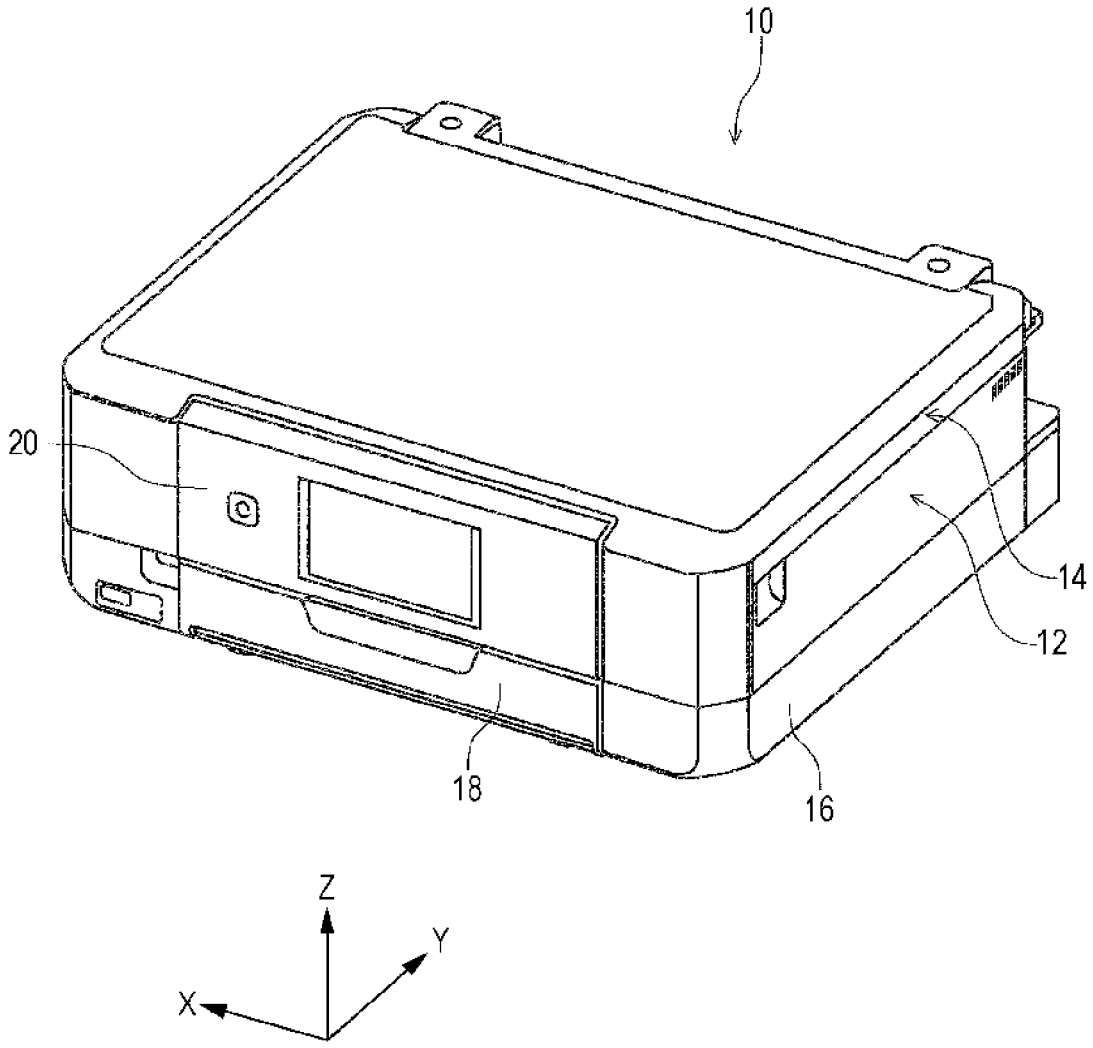
FIG. 1 is a perspective view of the exterior of a printer according to the invention.
Figure 2:
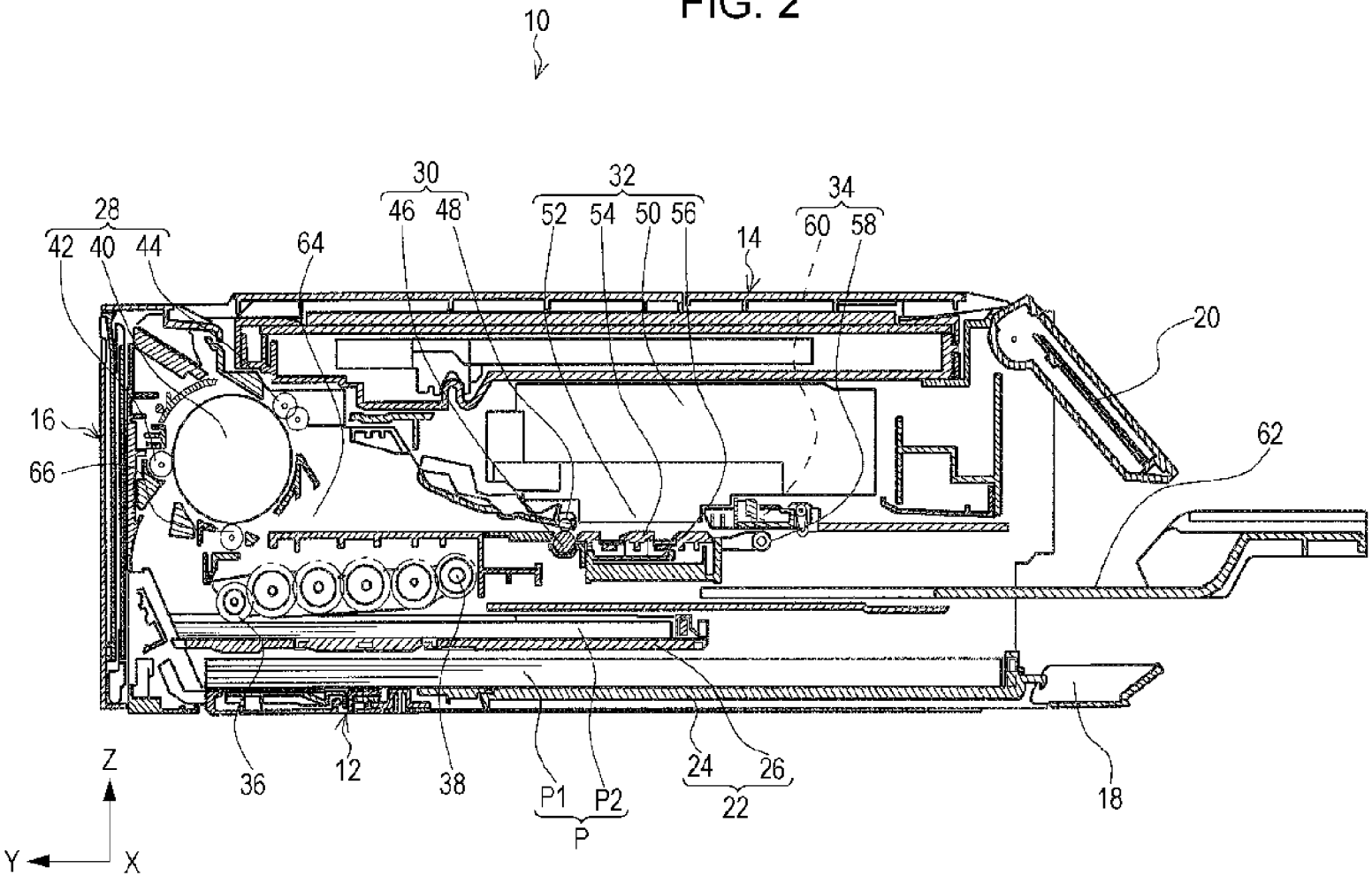
FIG. 2 is a cross-sectional side view illustrating a paper transport path of the printer according to the invention.
Figure 3:
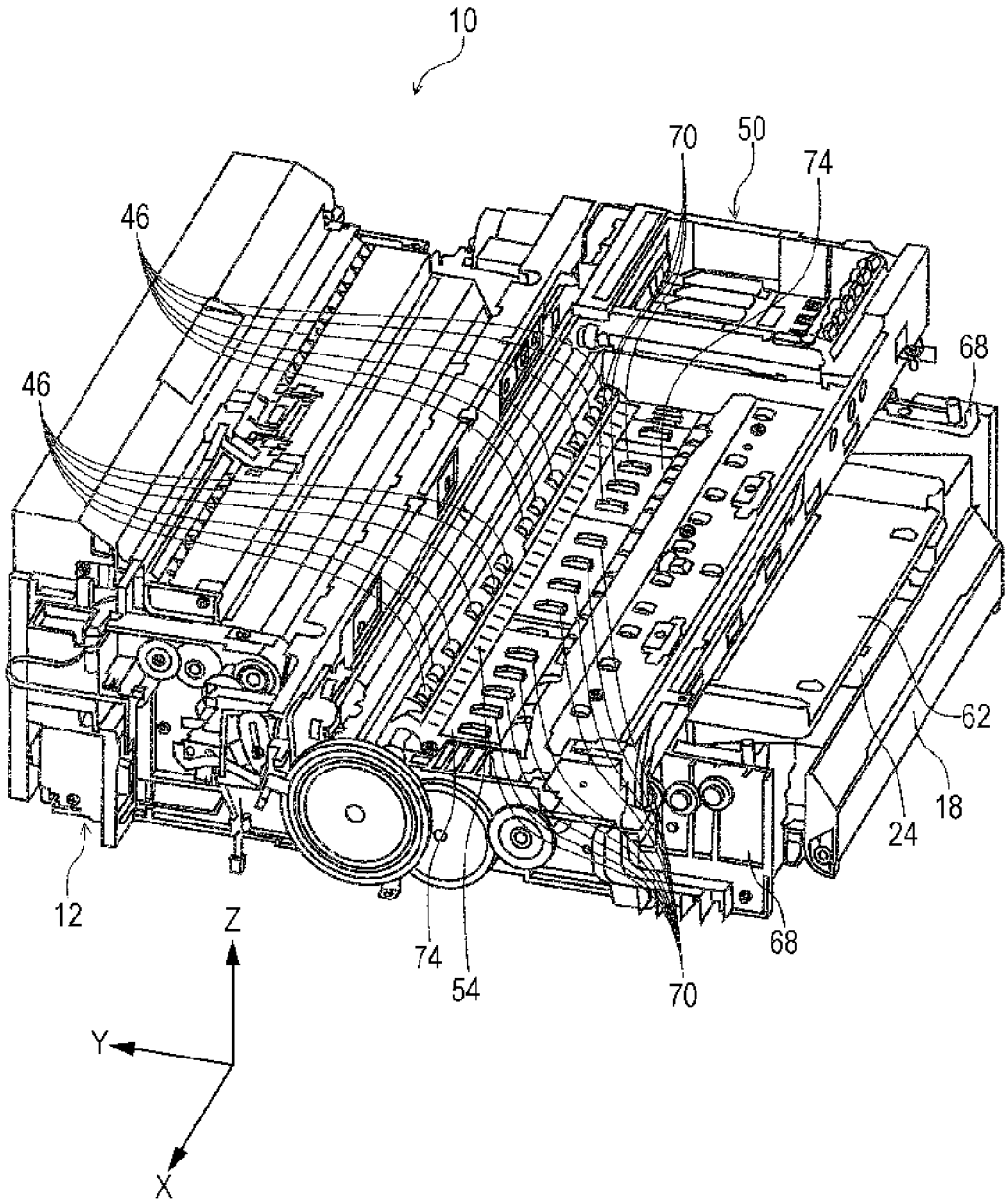
FIG. 3 is a perspective view illustrating the attachment state of a recording medium support member in a state where the exterior of the printer according to the invention is removed.
Figure 4:
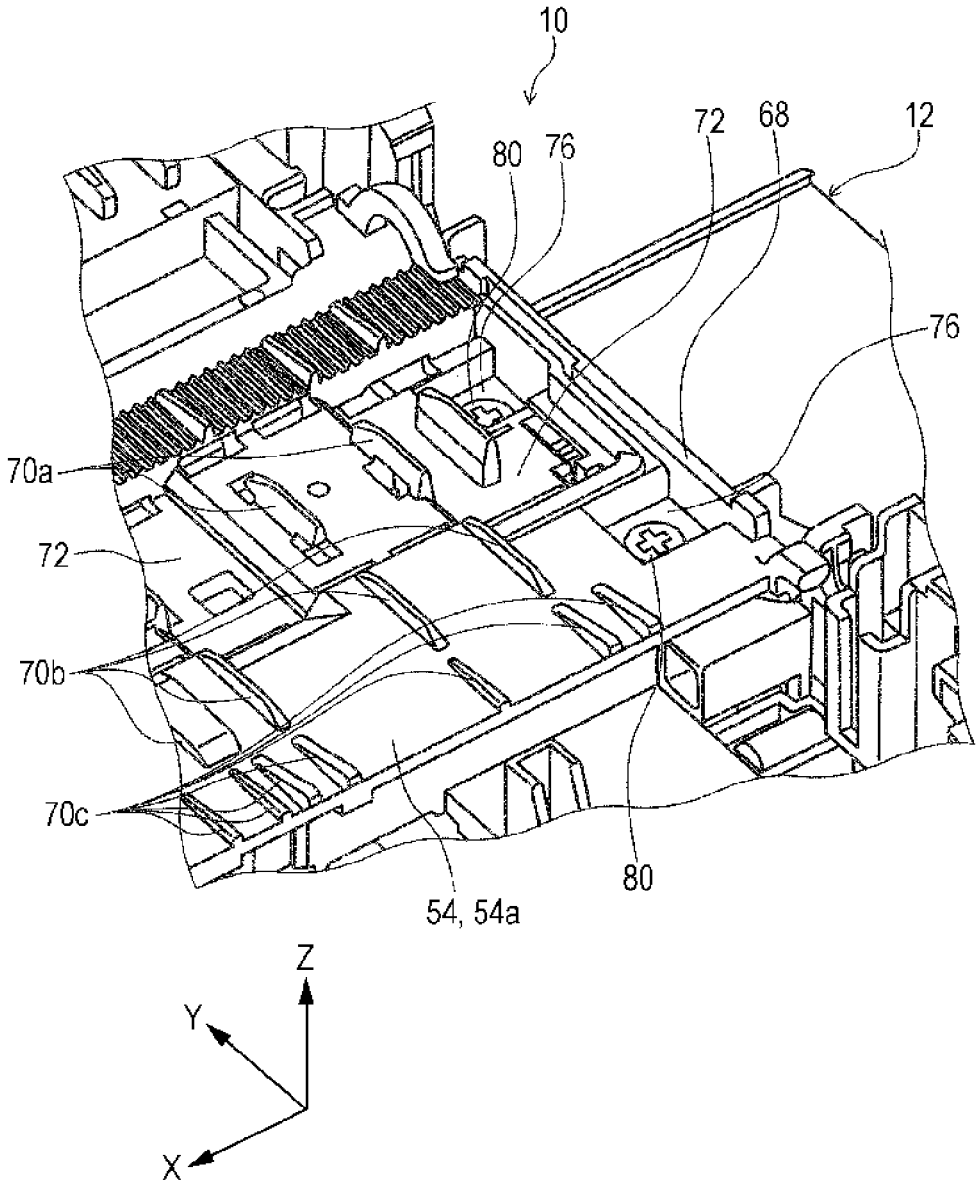
FIG. 4 is an enlarged view of the record head-facing side of the recording medium support member according to a first embodiment.

FIG. 1 is a perspective view of the exterior of a printer according to the invention. FIG. 2 is a cross-sectional side view illustrating a paper transport path of the printer according to the invention. FIG. 3 is a perspective view illustrating the attachment state of a recording medium support member in a state where the exterior of the printer according to the invention is removed. FIG. 4 is an enlarged view of the record head-facing side of the recording medium support member according to a first embodiment.

Figure 5:
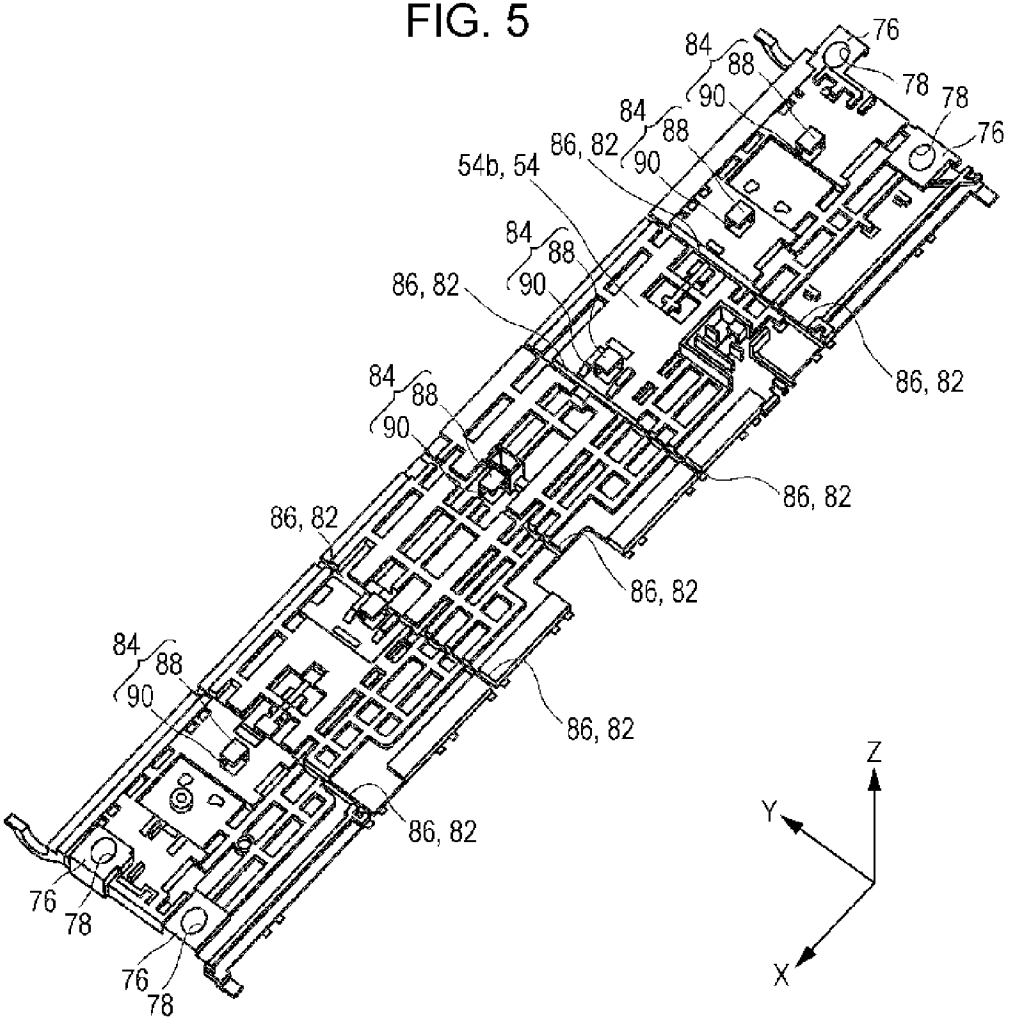
FIG. 5 is a perspective view illustrating the opposite side of the record head-facing side of the recording medium support member according to the first embodiment.
Figure 6:
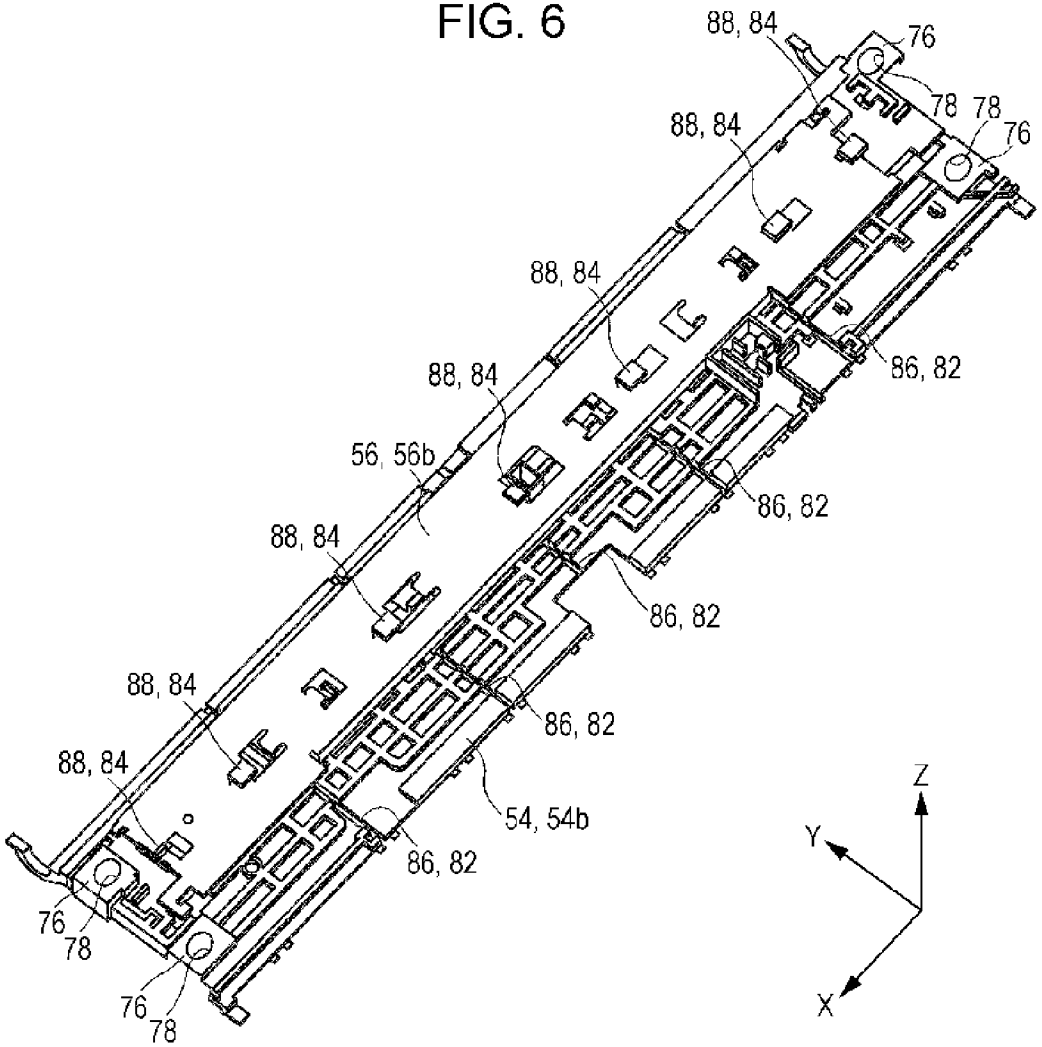
FIG. 6 is a perspective view illustrating a state where a reinforcing member is attached to the recording medium support member according to the first embodiment.
Figure 7A:
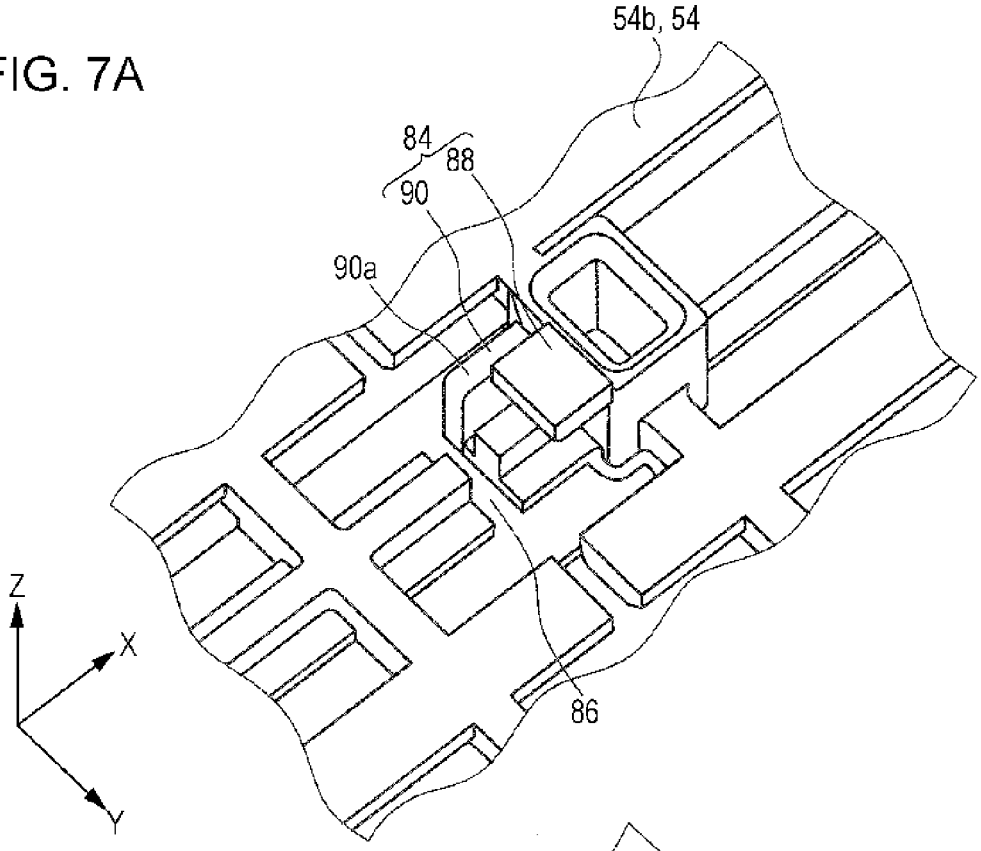
FIG. 7A is a perspective view illustrating a holding unit disposed in the recording medium support member according to the first embodiment.
Figure 7B:
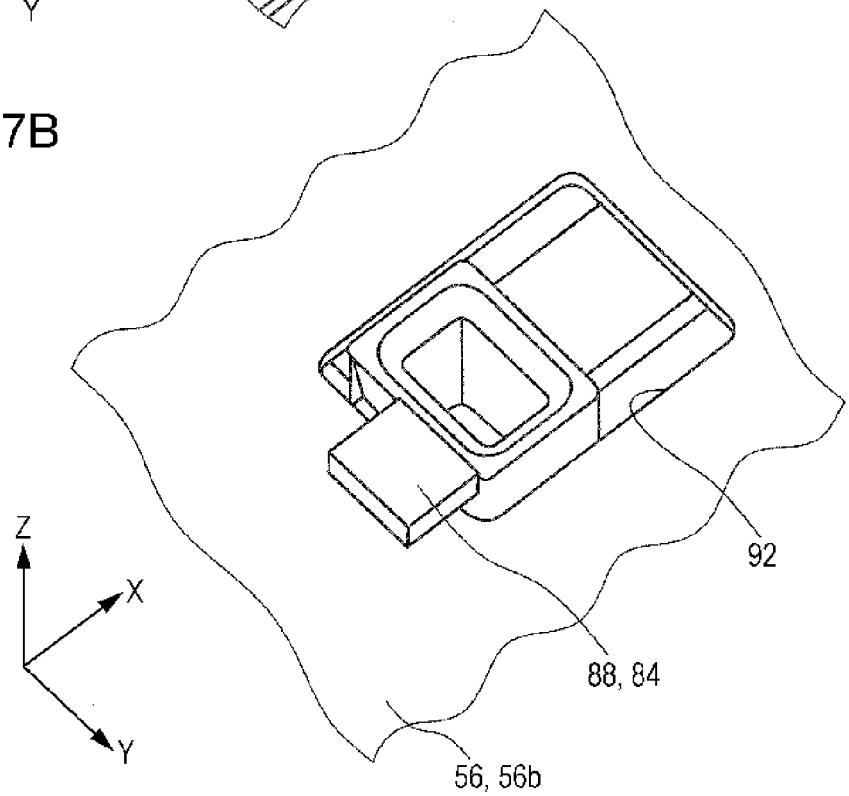
FIG. 7B is an enlarged view of the holding unit in the state where the reinforcing member is attached to the recording medium support member.
Figure 8A:
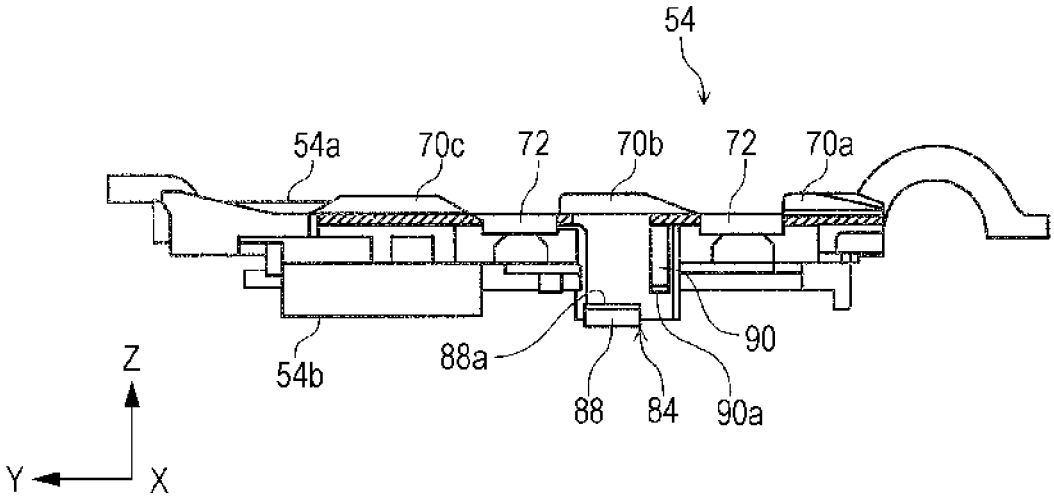
FIG. 8A is a cross-sectional side view of the recording medium support member.
Figure 8B:
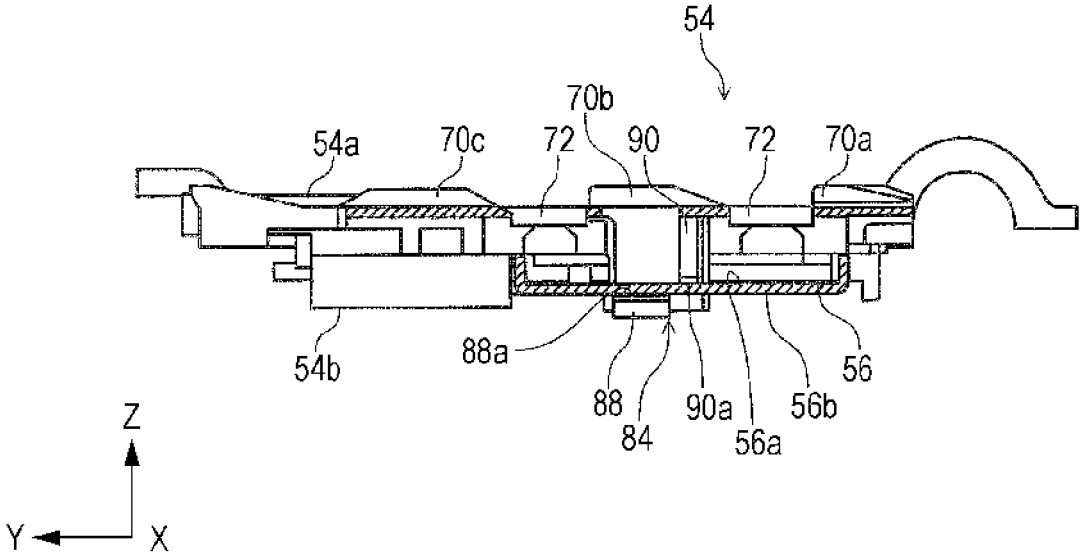
FIG. 8B is a cross-sectional side view of the recording medium support member in the state where the reinforcing member is attached thereto.

FIG. 5 is a perspective view illustrating the opposite side of the record head-facing side of the recording medium support member according to the first embodiment. FIG. 6 is a perspective view illustrating a state where a reinforcing member is attached to the recording medium support member according to the first embodiment. FIG. 7A is a perspective view illustrating a holding unit disposed in the recording medium support member according to the first embodiment. FIG. 7B is an enlarged view of the holding unit in the state where the reinforcing member is attached to the recording medium support member. FIG. 8A is a cross-sectional side view of the recording medium support member. FIG. 8B is a cross-sectional side view of the recording medium support member in the state where the reinforcing member is attached thereto.

Figure 9A:
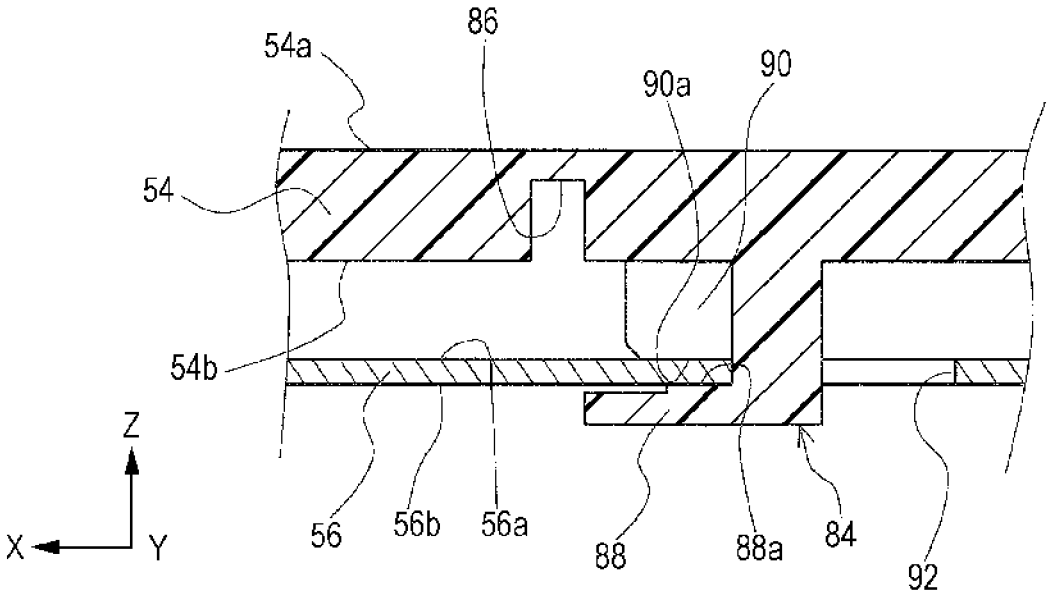
FIG. 9A is a cross-sectional view illustrating a state of the recording medium support member prior to deformation in a direction intersecting the transport direction of the recording medium.
Figure 9B:
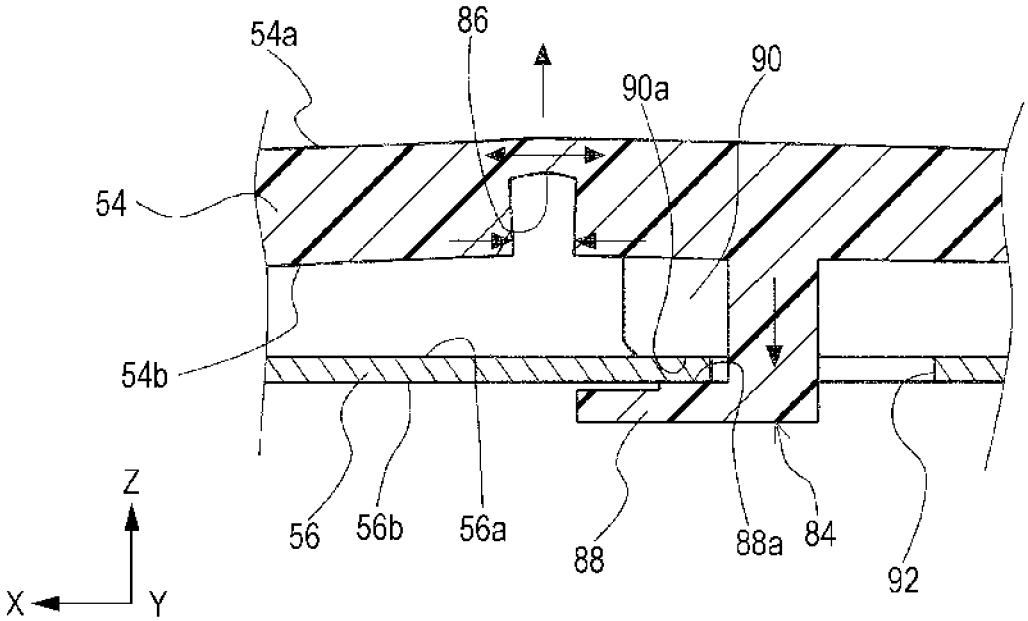
FIG. 9B is a cross-sectional view illustrating a state of the recording medium support member during deformation.
Figure 10A:
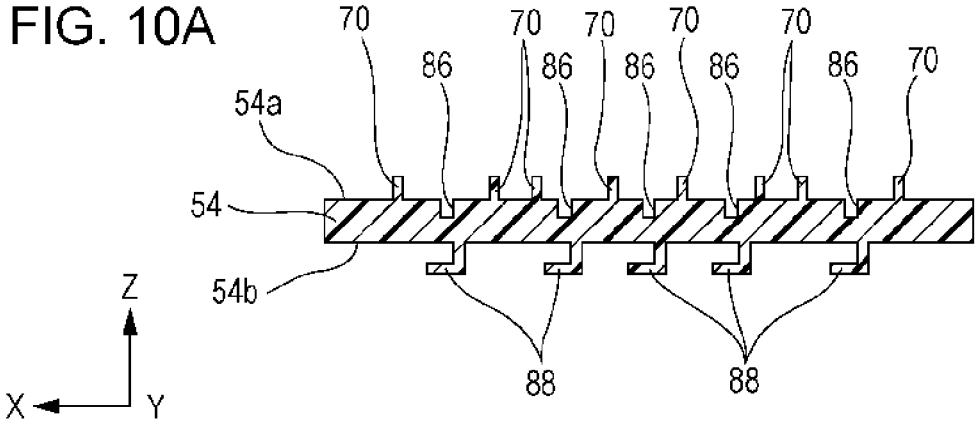
FIG. 10A is a cross-sectional view of a configuration as one modification example of the first embodiment in which grooves are disposed on the upper surface of the recording medium.
Figure 10B:
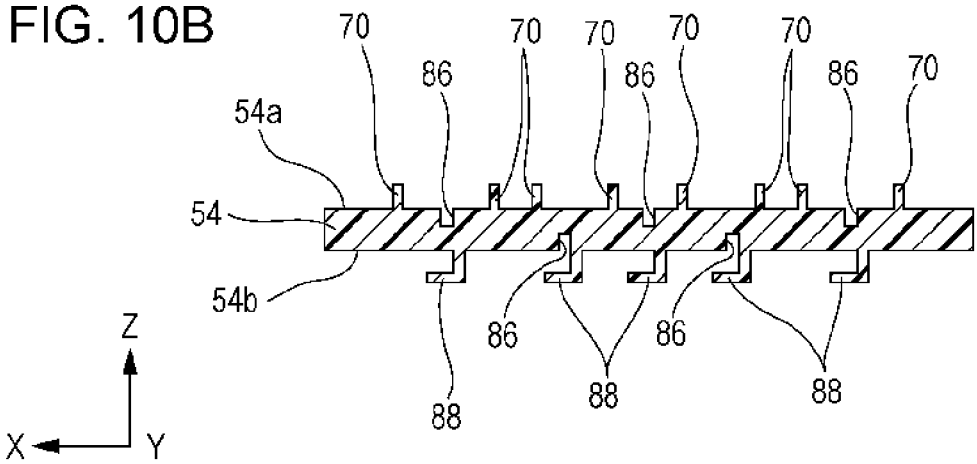
FIG. 10B is a cross-sectional view of a configuration as one modification example of the first embodiment in which grooves are alternately disposed on the upper surface and the lower surface of the recording medium.
Figure 10C:
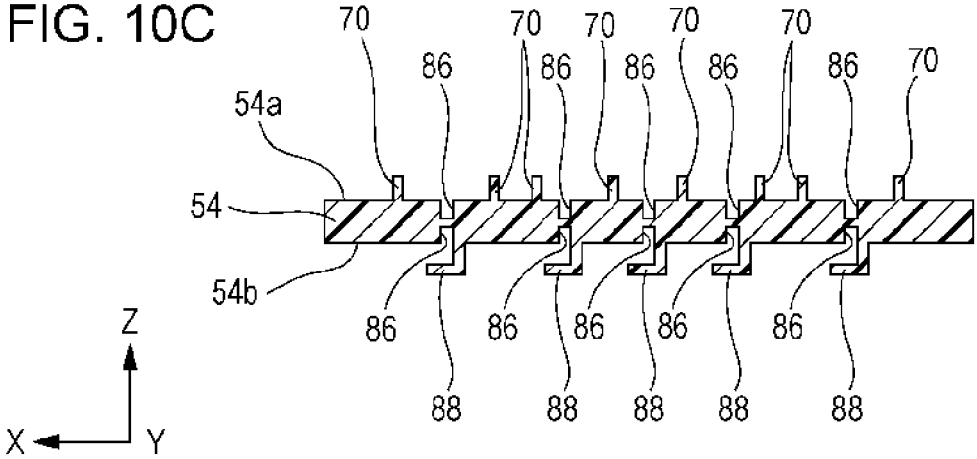
FIG. 10C is a cross-sectional view illustrating a configuration as one modification example of the first embodiment in which grooves are disposed at the same position on the upper surface and the lower surface of the recording medium.

FIG. 9A is a cross-sectional view illustrating a state of the recording medium support member prior to deformation in a direction intersecting the transport direction of the recording medium. FIG. 9B is a cross-sectional view illustrating a state of the recording medium support member during deformation. FIG. 10A is a cross-sectional view of a configuration as one modification example of the first embodiment in which grooves are disposed on the upper surface side of the recording medium. FIG. 10B is a cross-sectional view of a configuration as one modification example of the first embodiment in which grooves are alternately disposed on the upper surface and the lower surface of the recording medium. FIG. 10C is a cross-sectional view illustrating a configuration as one modification example of the first embodiment in which grooves are disposed at the same position on the upper surface and the lower surface of the recording medium.

Figure 11A:
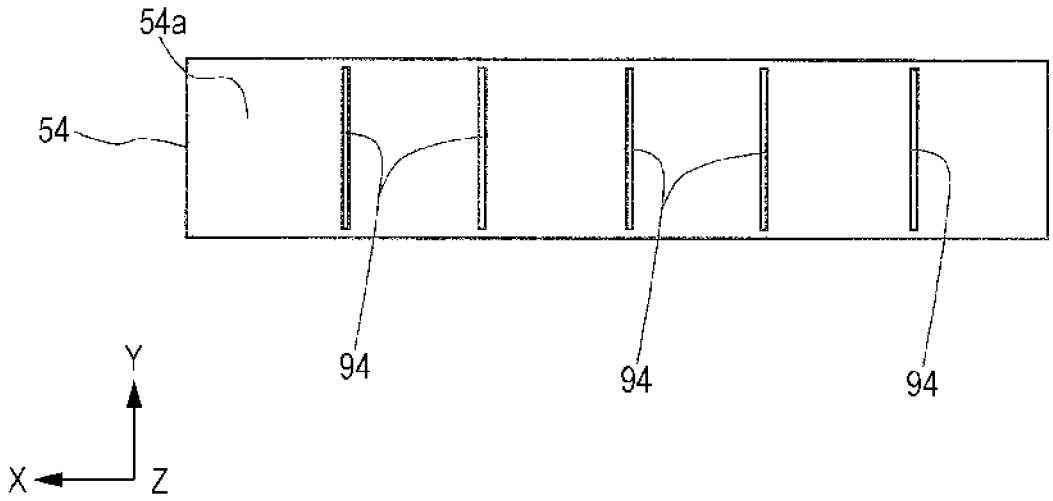
FIG. 11A is a plan view of a configuration as one modification example of the first embodiment in which slits are disposed to extend from the upstream side to the downstream side of the transport direction of the recording medium in the recording medium support member when viewed from the upper surface side of the recording medium.
Figure 11B:
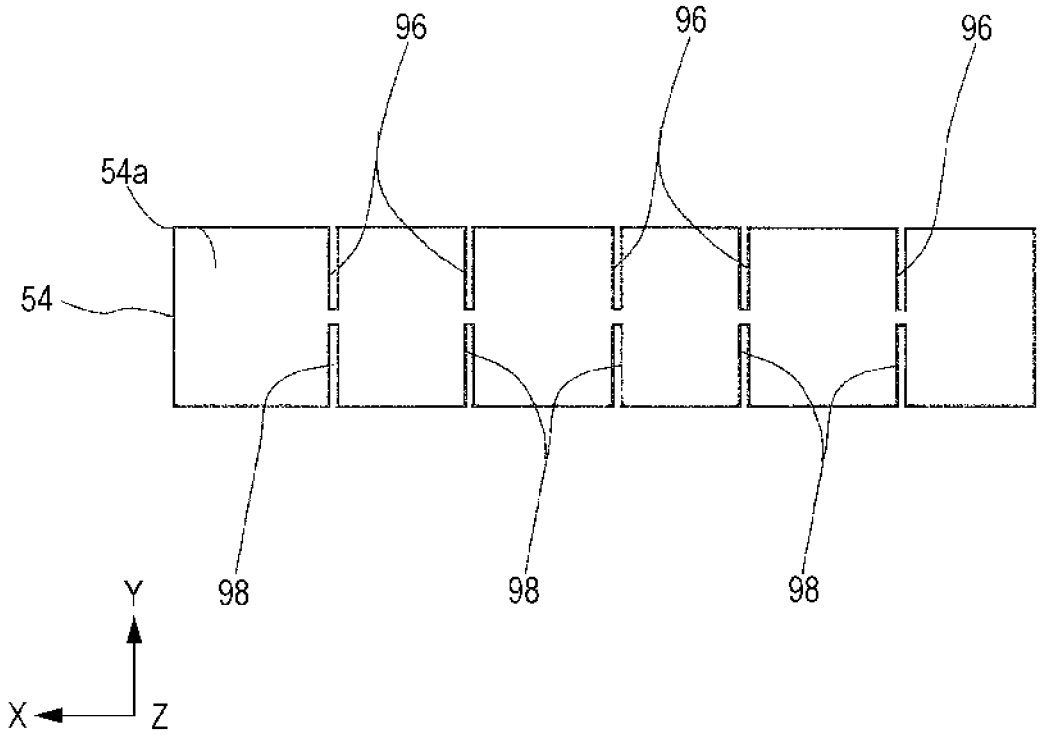
FIG. 11B is a plan view of a configuration in which slits are disposed from each of the upstream side and the downstream side of the transport direction of the recording medium to the central portion of the recording medium support member.

FIG. 11A is a plan view of a configuration as one modification example of the first embodiment in which slits are disposed to extend from the upstream side to the downstream side of the transport direction of the recording medium in the recording medium support member when viewed from the upper surface side of the recording medium. FIG. 11B is a plan view of a configuration in which slits each are disposed from the upstream side and the downstream side of the transport direction of the recording medium to the central portion of the recording medium support member.

In the X-Y-Z coordinate system illustrated in each drawing, the X direction denotes the scan direction of the recording head, the Y direction denotes the depth direction of a recording apparatus, and the Z direction denotes the direction of change of the distance (gap) between the recording head and a medium, that is, the height direction of the apparatus. In addition, the front surface side of the apparatus is in the −Y direction, and the rear surface side of the apparatus is in the +Y direction in each drawing.

Overview of Printer

Constituents of an ink jet printer 10 (hereinafter, referred to as "printer 10") as one example of the recording apparatus will be described with reference to FIG. 1 and FIG. 2. The printer 10 includes an apparatus main body 12 and an image reading device 14. The apparatus main body 12 includes a housing 16 that constitutes the exterior thereof, a cover body 18 that is openable/closable with respect to the housing 16 in the front surface of the housing 16, and an operation unit 20 that is disposed on the front surface of the housing 16. Although not illustrated, a medium accommodation unit 22 that is disposed inside the housing 16 is accessible when the cover body 18 is opened. The image reading device 14 is disposed in the upper portion of the apparatus main body 12 and although not illustrated, is configured to set and read a medium on a mounting surface like a so-called scanner.

The operation unit 20 is configured to include a power button for operating the printer 10, a print setting button, a display panel, and the like. In addition, the operation unit 20 is configured to be pivotable with respect to the housing 16 frontward of the apparatus by an unillustrated drive mechanism (refer to FIG. 2).

Next, constituents on the paper transport path will be described in further detail with reference to FIG. 2. The apparatus main body 12 is configured to include the medium accommodation unit 22, a feed unit 28, a transport unit 30, a recording unit 32, a discharge unit 34, and an unillustrated control unit. The medium accommodation unit 22 is configured to include a lower stage side tray 24 that accommodates papers as "recording medium" and an upper stage side tray 26 that is positioned on the upper side of the lower stage side tray 24 and accommodates papers. The lower stage side tray 24 and the upper stage side tray 26 each are configured to be attachable to and detachable from the apparatus main body 12 on the front side of the apparatus when the cover body 18 is opened toward the front surface of the housing 16.

In addition, the upper stage side tray 26 is driven by an unillustrated drive mechanism in the depth direction of the apparatus (+Y axis direction in FIG. 2) and is configured to be movable between an abutment position, that is, a position where feeding is possible (refer to FIG. 2) and a recess position (not illustrated) away from the abutment position by a predetermined displacement in the −Y direction. In FIG. 2, papers accommodated in the lower stage side tray 24 are denoted by a reference sign P1, and papers accommodated in the upper stage side tray 26 are denoted by a reference sign P2 (hereinafter, referred to as "paper P" when it is not necessary to be distinguished). The paper P is one example of the recording medium.

A pickup roller 36 that is driven to rotate by an unillustrated drive motor is disposed above each tray. The pickup roller 36 is disposed to be oscillatable around an oscillation shaft 38. The pickup roller 36 transports the uppermost paper P2 from the upper stage side tray 26 to a feed path by rotating in contact with the uppermost paper among the papers P2 accommodated in the upper stage side tray 26 when the upper stage side tray 26 is at the position where feeding is possible.

The pickup roller 36 transports the uppermost paper P1 from the lower stage side tray 24 to the feed path by rotating in contact with the uppermost paper among the papers P1 accommodated in the lower stage side tray 24 when the upper stage side tray 26 is at the recess position.

The paper P1 accommodated in the lower stage side tray 24 or the paper P2 accommodated in the upper stage side tray 26 is transported by the pickup roller 36 to the feed unit 28 that is arranged on the downstream side of the feed path. The feed unit 28 includes a feed drive roller 40 that is driven by an unillustrated drive motor, a feed passive roller 42, and a feed passive roller 44. The feed passive roller 42 is brought into contact with the feed drive roller 40 and separates the paper P. The feed passive roller 42 securely transports only the uppermost paper P to the downstream side of the feed path.

The feed passive roller 44 is disposed on the downstream side of the feed passive roller 42. The feed passive roller 44 is passively rotated while pinching the paper P between the feed drive roller 40 and the feed passive roller 44. Furthermore, the transport unit 30 is disposed on the downstream side of the feed path of the feed passive roller 44. The transport unit 30 includes a transport drive roller 46 that is driven by an unillustrated drive motor and a transport passive roller 48 that is in pressed contact with the transport drive roller and is passively rotated. The transport unit 30 further transports the paper P to the downstream side of the feed path.

The recording unit 32 is disposed on the downstream side of the transport unit 30. The recording unit 32 includes a carriage 50, a recording head 52, a platen 54 as "medium support member" that faces the recording head and supports the paper P, and a reinforcing member 56 that is attached to the platen 54, has a greater rigidity than the platen 54, and has a smaller thermal expansion coefficient than the platen 54. The recording head 52 is disposed on the bottom portion of the carriage 50 and faces the paper P. The carriage 50 is driven to reciprocate in the X axis direction in FIG. 3 by an unillustrated drive motor.

The platen 54 supports the paper P and defines the distance between the platen 54 and the recording head 52, that is, a gap PG. The discharge unit 34 is disposed on the downstream side of the platen 54. The discharge unit 34 transports the paper P after recording is performed thereon. The discharge unit 34 includes a first roller 58 that is driven to rotate by an unillustrated drive motor and a second roller 60 that is in contact with the first roller 58 and is passively rotated.

The paper P after recording is performed by the recording unit 32 is pinched between the first roller 58 and the second roller 60 and is discharged to a paper discharge stacker 62 that is disposed on the front surface side (right side in FIG. 2) of the apparatus main body 12. The paper discharge stacker 62 is configured to be switchable between the state where the paper discharge stacker 62 is displaced in a direction protruding outside the apparatus main body 12, that is, drawn out along the Y axis direction along with the operation unit 20 pivoting with respect to the apparatus main body 12 and the state where the paper discharge stacker 62 is displaced in a direction being drawn inside the apparatus main body 12.

The operation unit 20 pivots with respect to the apparatus main body 12 in a counterclockwise direction in FIG. 2 when the paper discharge stacker 62 is displaced in the direction protruding outside the apparatus main body 12. That is, the operation unit 20 is opened with respect to the apparatus main body 12. In addition, the operation unit 20 pivots with respect to the apparatus main body 12 in a clockwise direction in FIG. 2 when the paper discharge stacker 62 is displaced in the direction being drawn inside the apparatus main body 12. That is, the operation unit 20 is closed with respect to the apparatus main body 12.

When recording is performed on both sides of the paper P in the printer 10, a first side of the paper P is recorded by the recording unit 32. Thereafter, the paper P is returned to the upstream side of the transport unit 30 while the trailing edge of the paper when the first side is recorded is reversed to be the leading edge by a reverse transport operation of the transport unit 30 and the discharge unit 34. The paper P is further transported to an inversion path 64 by a return operation of the transport unit 30. The paper transported inside the inversion path 64 is pinched by the feed drive roller 40 and an inversion roller 66 and is returned to the feed path.

The paper P returned to the feed path is transported again to the transport unit 30 on the downstream side of the feed path via the feed passive roller 42 and the feed passive roller 44 by the feed drive roller 40. At this time, the first side and the second side of the paper P are inverted in a curved manner, and the second side faces the recording head 52. The paper P is transported to the recording unit 32 by the transport unit 30. The paper P of which the second side is recorded by the recording unit 32 is pinched in the discharge unit 34 and discharged to the paper discharge stacker 62 that is disposed on the front side of the apparatus.

The control unit (not illustrated) controls operations necessary for the printer 10 to perform recording and image reading such as feeding, transporting, discharging, recording, and document reading operations with respect to the medium in the medium accommodation unit 22, the feed unit 28, the transport unit 30, the recording unit 32, the discharge unit 34, and the image reading device 14 according to input commands from the operation unit 20.

The control unit may control the operations necessary for the printer 10 to perform recording and image reading such as the document reading operation and the like according to instructions from the external unit (PC and the like) instead of the input commands from the operation unit 20. In addition, the control unit (not illustrated) controls the movement of the carriage 50 in the scan direction (X axis direction in FIG. 4) in the recording unit 32.

Regarding First Embodiment

The platen 54 will be described with reference to FIG. 3 to FIG. 8B. With reference to FIG. 3, the platen 54 is positioned below the carriage 50 in the apparatus main body 12 and is disposed so as to face the recording head 52 in an area where the carriage 50 is movable. The apparatus main body 12 includes a pair of frames 68 and 68 that is arranged at an interval in the X axis direction as illustrated in FIG. 3. In the present embodiment, both end portions of the platen 54 in the X axis direction are supported by the frames 68 and 68 (refer to FIG. 4).

A plurality of ribs 70 stands on the side of the platen 54, that is, on an upper surface 54*a* facing the recording head 52. The plurality of ribs 70 supports the paper P when the paper P is transported to the platen 54. The ribs 70 are plurally (70*a*, 70*b*, and 70*c*) arranged along the Y axis direction, that is, the transport direction of the paper P as illustrated in FIG. 4. In addition, the ribs 70*a*, 70*b*, and 70*c* are plurally arranged at appropriate intervals in the X axis direction.

A plurality of concave portions 72 is disposed on the upper surface 54*a* of the platen 54 as illustrated in FIG. 4. An ink-absorbent material 74 is attached to the concave portion 72 as illustrated in FIG. 3. The ink-absorbent material 74 is disposed to correspond to an area where the recording head 52 performs recording. That is, the ink-absorbent material 74 is arranged in the platen 54 so as to absorb ink that is ejected from the recording head 52 and falls down without landing on the paper P when borderless recording is performed on the paper P.

The platen 54 is configured as a plate-shaped member that extends in the X axis direction which is the direction intersecting the transport direction of the paper P as illustrated in FIG. 5. The platen 54 is formed of a conductive material in the present embodiment. Attachment units 76, 76, 76, and 76 for attaching the platen 54 to the frames 68 and 68 are disposed in both end portions of the platen 54 in the X axis direction.

The attachment unit 76 defines the position of the platen 54 in the Z axis direction with respect to the apparatus main body 12 when the platen 54 is attached to the frame 68. An elongated hole 78 is disposed in the attachment unit 76. The platen 54 is attached to the frame 68 by a screw member 80 that passes through the elongated hole 78 as illustrated in FIG. 4. The elongated hole 78 is formed to be long in the X axis direction. That is, the elongated hole 78 allows the platen 54 to expand and contract in the X axis direction within the range of the length of the elongated hole 78 in the X axis direction in response to environmental change such as humidity when the platen 54 is attached to the frame 68 by the screw member 80.

A rigidity reduction unit 82 and a holding unit 84 are plurally disposed on a side of the platen 54 opposite to the recording head-facing side, that is, on a lower surface 54*b*. The rigidity reduction unit 82 includes a plurality of grooves 86 in the present embodiment. The plurality of grooves 86 is disposed on the lower surface 54*b* at appropriate intervals in the X axis direction. The groove 86 extends along the Y axis direction that is the transport direction of the paper P on the lower surface 54*b*. In the platen 54, the thickness of the part where the groove 86 is disposed is smaller than the thickness of the part where the groove 86 is not disposed. Accordingly, the platen 54 is likely to bend in the X axis direction at the part where the groove 86 is disposed and thus has bendability.

Disposing the groove 86 that extends along the Y axis direction plurally on the platen 54 at an interval in the X axis direction allows the rigidity reduction unit 82 to be capable of reducing the rigidity of the platen 54 in the X axis direction since the platen 54 is likely to bend at the part where the groove 86 is disposed.

The holding unit 84 includes a hook 88 and an engagement unit 90 as illustrated in FIG. 7A. The hook 88 is formed to protrude in the −Z axis direction from the lower surface 54*b*. In addition, the hook 88 is disposed at an interval in the X axis direction and corresponds to the position of the groove 86. That is, the hook 88 is in close proximity to the groove 86. The engagement unit 90 also protrudes from the lower surface 54*b* in the −Z axis direction and is formed below the hook 88 in the Z axis direction as illustrated in FIG. 8A. The distance between the hook 88 and the engagement unit 90 in the Z axis direction is set to be capable of holding the reinforcing member 56 therebetween as illustrated in FIG. 8B.

FIG. 6 illustrates a state of the plate-shaped reinforcing member 56 that is attached to the lower surface 54*b* of the platen 54 via the hook 88. The reinforcing member 56 extends in the X axis direction like the platen 54. In addition, the reinforcing member 56 is formed to have a greater rigidity than the platen 54. The reinforcing member 56 has a greater rigidity than the conductive material that constitutes the platen 54 and is formed of a ferrous material of which the thermal expansion coefficient is small.

A plurality of elongated holes 92 is formed in the reinforcing member 56 along the X axis direction (refer to FIG. 6 and FIG. 7B). When the reinforcing member 56 is attached to the platen 54, the hook 88 passes through the elongated hole 92 of the reinforcing member 56, and the reinforcing member 56 is slid in the X axis direction between the hook 88 and the engagement unit 90 in the Z axis direction. Thus, the reinforcing member 56 is attached to the lower surface 54*b* of the platen 54 (refer to FIG. 6 and FIG. 7B). Accordingly, the reinforcing member 56 can be easily attached to the platen 54.

An engagement surface 88*a* (refer to FIG. 8A) of the hook 88 engages with a lower surface 56*b* of the reinforcing member 56, and an engagement surface 90*a* of the engagement unit 90 (refer to FIG. 8A) engages with an upper surface 56*a* of the reinforcing member 56 when the reinforcing member 56 is attached to the lower surface 54*b* of the platen 54 as illustrated in FIG. 8B. Accordingly, the reinforcing member 56 is securely held in the holding unit 84 of the platen 54 in the Z axis direction when the reinforcing member 56 is attached to the platen 54.

Next, a state of the platen 54 where the platen 54 expands in response to environmental change such as temperature and humidity will be described with reference to FIG. 9A and FIG. 9B. The holding unit 84 of the platen 54 in FIG. 9A is in the state of holding the reinforcing member 56 before the reinforcing member 56 expands.

The platen 54 tends to be extended in the X axis direction due to change in volume when the platen 54 expands in response to environmental change such as temperature and humidity. As illustrated in FIG. 9B, difference occurs between the amount of the expansion in the X axis direction on the upper surface 54*a* and the lower surface 54*b* in the part of the platen 54 where the groove 86 is disposed. In addition, the part where the groove 86 is disposed has a smaller thickness than the part where the groove 86 is not disposed in the platen 54. Thus, the rigidity of the platen 54 is decreased by the thickness difference, and the platen 54 is likely to bend.

As a consequence, the upper surface 54*a* curves toward the +Z axis direction side in FIG. 9B with the lower surface 54*b* being the inner side of the curve, and bending occurs in the groove 86 toward the +Z axis direction side since the upper surface 54*a* is extended greater than the lower surface 54*b* when the platen 54 expands in the X axis direction.

The holding unit 84 is disposed to correspond to the position of the groove 86. Thus, the holding unit 84 stretches the reinforcing member 56 that has a greater rigidity than the platen 54 when the part of the platen 54 where the groove 86 is disposed is deformed to curve toward the +Z axis direction. However, the rigidity of the reinforcing member 56 is set to be greater than the rigidity of the platen 54 in the present embodiment. In addition, the thermal expansion coefficient of the reinforcing member 56 is set to be smaller than that of the platen 54. As a consequence, the part of the platen 54 where the groove 86 is disposed is held in the reinforcing member 56 via the holding unit 84 and is prevented from separating from the reinforcing member 56.

That is, the platen 54 follows the reinforcing member 56 that has a greater rigidity than the platen 54 along the X axis direction when the platen 54 expands in the X axis direction. In addition, since the platen 54 follows the reinforcing member 56 because the rigidity of the reinforcing member 56 is greater than that of the platen 54, and the thermal expansion coefficient of the reinforcing member 56 is smaller than that of the platen 54, the platen 54 is dependent on the accuracy of the reinforcing member 56, and the amount of deformation of the platen 54 in the Z axis direction can be reduced. Furthermore, the amount of deformation of the platen 54 in the X axis direction can be distributed to each groove 86, and the total amount of deformation of the platen 54 can be reduced since the groove 86 is plurally disposed in the platen 54 along the X axis direction.

In a case, for example, where the groove 86 is not configured to be disposed in the platen 54, stress caused by expansion is concentrated on the central portion of the platen 54 in the X axis direction if the platen 54 expands greater than the allowable extension amount of the elongated hole 78 of the platen 54 in the X axis direction when the platen 54 expands in the X axis direction. As a consequence, the central portion greatly bends in the +Z axis direction or the −Z axis direction since both end portions of the platen 54 are bound by the frames 68 and 68.

Consequently, the gap PG between the recording head 52 and the platen 54 changes in the X axis direction. Thus, recording quality on the paper P may be degraded. In addition, the recording head 52 and the paper P may rub against each other to cause the head to wear if recording is performed on the paper P when the central portion of the platen 54 greatly bends in the +Z axis direction. Alternatively, difference may occur in the force of transport of the paper P to cause failure in transporting the paper P on the transport path of the paper P because of the platen 54 greatly bending.

In the present embodiment, the platen 54 can bend at multiple places in the X axis direction by disposing the plurality of grooves 86 in the platen 54 as the rigidity reduction unit 82 along the X axis direction. As a consequence, great deformation of the platen 54 in the central portion thereof in the X axis direction is reduced, and the reinforcing member 56 is securely held by the holding unit 84. Thus, the platen 54 can securely follow the reinforcing member 56 along the X axis direction. Therefore, degradation of recording quality on the paper P, wear of the head, and occurrence of failure in transporting the paper P can be reduced.

Summarizing the above description, the platen 54 that supports the paper P is attached to the reinforcing member 56 that has a greater rigidity than the platen 54 and has bendability that allows the platen 54 to follow the reinforcing member 56 in the X axis direction which is the direction intersecting the transport direction of the paper P. Accordingly, the platen 54 is dependent on the accuracy of the reinforcing member 56 since the platen 54 follows the reinforcing member 56 in the X axis direction when the platen 54 bends due to change in volume caused by environmental change such as humidity. As a consequence, deformation of the platen 54 can be suppressed on the transport path of the paper P. Therefore, degradation of recording quality on the paper P or occurrence of failure in transporting the paper P can be reduced.

The reinforcing member 56 has a smaller thermal expansion coefficient than the platen 54. Since the reinforcing member 56 has a small thermal expansion coefficient, expansion of the reinforcing member 56 can be suppressed greater than that of the platen 54 when the temperature around the reinforcing member 56 and the platen 54 rises, and the reinforcing member 56 and the platen 54 thermally expand. As a consequence, the reinforcing member 56 maintains the state thereof close to the state before expansion since the volume change before and after expansion is small. Accordingly, the platen 54 that expands in response to the volume change follows the reinforcing member 56 in the X axis direction because of the bendability of the platen 54. Consequently, deformation of the platen 54 can be suppressed on the transport path of the paper P. Therefore, degradation of recording quality on the paper P can be suppressed, and occurrence of failure in transporting the paper P can be reduced.

The platen 54 is attached to the reinforcing member 56 that has a greater rigidity than the medium support member and has the rigidity reduction unit 82 that reduces the rigidity of the platen 54 in the X axis direction which is the direction intersecting the transport direction of the paper P. Accordingly, the platen 54 follows the reinforcing member 56 attached to the platen 54 when the platen 54 bends due to change in volume caused by environmental change such as humidity since the rigidity reduction unit 82 allows the rigidity of the platen 54 to be smaller than that of the reinforcing member 56. As a consequence, the platen 54 is dependent on the accuracy of the reinforcing member 56, and the amount of deformation of the platen 54 can be reduced. Therefore, degradation of recording quality on the paper P or failure in transporting the paper P can be reduced on the transport path of the paper P.

The rigidity reduction unit 82 includes the groove 86 that extends along the Y axis direction and is plurally disposed at an interval in the X axis direction. Accordingly, the platen 54 is likely to follow the shape of the reinforcing member 56 in the X axis direction since the platen 54 curves at the part where the plurality of grooves 86 is disposed in the X axis direction when the platen 54 follows the reinforcing member 56. As a consequence, deformation of the platen 54 can be reduced, and degradation of recording quality on the paper P or occurrence of failure in transporting the paper P can be reduced on the transport path of the paper P since the platen 54 follows the reinforcing member 56 in the X axis direction.

The plurality of holding units 84 that holds the reinforcing member 56 at intervals in the X axis direction is arranged in the platen 54 to correspond to the position of the groove 86. The platen 54 is likely to curve at the part where the groove 86 is disposed when the platen 54 bends due to change in volume caused by environmental change such as humidity and the like. The part where the groove 86 is disposed tends to bend in a direction separating from the reinforcing member 56 when the groove 86 is disposed on a side of the platen 54 that faces the reinforcing member 56, that is, on the lower surface 54*b* of the platen 54. Accordingly, forming the holding unit 84 in the platen 54 to correspond to the position of the groove 86 suppresses separation of the part where the groove 86 is disposed from the reinforcing member 56 when the platen 54 curves at the part where the plurality of grooves 86 is disposed in the X axis direction. As a consequence, the platen 54 can securely follow the reinforcing member 56 in the X axis direction.

In addition, the paper P transported along the transport path of the paper P is free from being caught in the groove 86 since the groove 86 is disposed on the lower surface 54*b* of the platen 54. Therefore, occurrence of failure in transporting the paper P can be reduced.

Meanwhile, the material of the platen 54 is not particularly defined in the present embodiment. The platen 54 can be formed of a conductive resin as one example of measures against attachment of paper dust. The platen 54 tends to be greatly deformed when the platen 54 is formed of the conductive material. The rigidity reduction unit 82 in the present embodiment is particularly effective for the platen 54 that is formed of a conductive resin because the rigidity reduction unit 82 decreases the rigidity of the platen 54 so that the platen 54 follows the reinforcing member 56.

Modification Example of First Embodiment (1) The groove 86 may be configured to be disposed on the upper surface 54*a* as illustrated in FIG. 10A instead of the configuration in which the groove 86 is disposed on the lower surface 54*b* of the platen 54 in the present embodiment.

According to this configuration, the central portion of the platen 54 in the X axis direction bends in a direction separating from the recording head 52, that is, in the −Z axis direction when the platen 54 expands in response to humidity change since the groove 86 is disposed on the upper surface 54*a* of the platen 54. As a consequence, the gap PG between the recording head 52 and the platen 54 becomes great. Thus, occurrence of wear of the head caused by contact between the recording head 52 and the paper P can be reduced.

(2) The groove 86 may be configured to be alternately disposed on the upper surface 54*a* and the lower surface 54*b* as illustrated in FIG. 10B instead of the configuration in which the groove 86 is disposed on the lower surface 54*b* of the platen 54 in the present embodiment.

(3) The groove 86 may be configured to be disposed at the same position on the upper surface 54*a* and the lower surface 54*b* in the X axis direction as illustrated in FIG. 10C instead of the configuration in which the groove 86 is disposed on the lower surface 54*b* of the platen 54 in the present embodiment. That is, only the central portion of the platen 54 in the thickness direction thereof (Z axis direction) may be configured to be continuous.

(4) A slit 94 may be configured to be disposed to penetrate the platen 54 in the Z axis direction as illustrated in FIG. 11A instead of the configuration in which the groove 86 is disposed on the lower surface 54*b* of the platen 54 in the present embodiment. The slit 94 extends along the Y axis direction in the example in FIG. 11A.

(5) A slit 96 that extends toward the central portion of the platen 54 from the +Y axis direction side and a slit 98 that is disposed at the same position as that of the slit 96 in the X axis direction and extends toward the central portion of the platen 54 from the −Y axis direction side may be configured to be included instead of the configuration in which the groove 86 is disposed on the lower surface 54*b* of the platen 54 in the present embodiment, as illustrated in FIG. 11B.

(6) A plurality of holes may be configured to be disposed in the platen 54 to reduce the rigidity of the platen instead of the configuration in which the rigidity reduction unit 82 is configured as the groove 86 in the present embodiment. Alternatively, the thickness of the platen 54 may be configured to be fully thinned to reduce the rigidity thereof. Alternatively, the thickness of the platen 54 may be configured to decrease stepwise or gradually from the end portion to the central portion thereof along the X axis direction. Disposing the plurality of holes in the platen 54 as the rigidity reduction unit 82 can reduce the rigidity of the platen 54. Thus, the platen 54 is likely to follow the reinforcing member 56.

(7) The frames 68 and 68 may be configured to support the platen 54 at least at two places in the X axis direction at an appropriate interval instead of the configuration in which the frames 68 and 68 support the platen 54 at both end portions of the platen 54 in the X axis direction in the present embodiment. Alternatively, a member other than the frames 68 and 68 may be configured to support the platen 54.

(8) The holding unit 84 may be configured by a bias member such as a spring that pulls the reinforcing member 56 toward the platen 54 instead of the configuration in which the holding unit 84 that holds the reinforcing member 56 in the platen 54 is configured to include the hook 88 in the present embodiment.

Summarizing the above description, the printer 10 in the present embodiment includes the recording head 52 that performs recording on the paper P, the platen 54 that is disposed at a position where the platen 54 can face the recording head 52 and supports the paper P, and the reinforcing member 56 that is attached to the platen 54 and has a greater rigidity than the platen 54. The platen 54 has bendability to follow the reinforcing member 56 in the X axis direction that is the direction intersecting the transport direction of the paper P. The reinforcing member 56 has a smaller thermal expansion coefficient than the platen 54. In addition, the platen 54 follows the reinforcing member 56 in response to environmental change.

The printer 10 in the present embodiment includes the recording head 52 that performs recording on the paper P, the platen 54 that is disposed at a position where the platen 54 can face the recording head 52 and supports the paper P, and the reinforcing member 56 that is attached to the platen 54 and has a greater rigidity than the platen 54. The platen 54 includes the rigidity reduction unit 82 that reduces the rigidity of the platen 54 in the X axis direction which is the direction intersecting the transport direction of the paper P.

The reinforcing member 56 has a smaller thermal expansion coefficient than the platen 54. In addition, the platen 54 follows the reinforcing member 56 in response to environmental change. In addition, the reinforcing member 56 is disposed below the platen 54.

The rigidity reduction unit 82 includes the groove 86 that extends along the Y axis direction and is plurally disposed at an interval in the X axis direction. The platen 54 includes the plurality of holding units 84 that supports the reinforcing member 56 at intervals in the X axis direction. The holding unit 84 is disposed to correspond to the position of the groove 86. The holding unit 84 includes the hook 88 that hooks the reinforcing member 56 in the platen 54.

The groove 86 is disposed on the side of the platen 54 opposite to the side that faces the recording head 52, that is, on the lower surface 54*b*. Alternatively, the groove 86 is disposed on the side of the platen 54 that faces the recording head 52, that is, on the upper surface 54*a*. The rigidity reduction unit 82 includes a hole that is plurally disposed in the platen 54. The platen 54 is formed of a conductive resin.

In the present embodiment, the platen 54 according to the invention is applied to the ink jet printer that is one example of a recording apparatus but can be generally applied to other liquid ejecting apparatuses.

The liquid ejecting apparatus is not limited to a recording apparatus such as a printer, a copy machine, a facsimile, and the like that uses an ink jet type recording head to perform recording on a recording medium by ejecting ink from the recording head. The liquid ejecting apparatus includes an apparatus that ejects liquid other than ink depending on the application to an emission target medium which corresponds to the recording medium from a liquid ejecting head which corresponds to the ink jet type recording head to allow the liquid to adhere to the emission target medium.

As the liquid ejecting head, a coloring material ejecting head used in manufacturing color filters such as liquid crystal displays and the like, an electrode material (conductive paste) ejecting head used in forming electrodes such as organic EL displays, field emission displays (FED), and the like, a bio-organic material ejecting head used in manufacturing bio-chips, and a sample ejecting head as a precise pipette may be exemplified.

The invention is not limited to the above embodiments. Various modifications can be made within the scope of the invention described in the claims and are apparently included in the scope of the invention.

The entire disclosure of Japanese Patent Application No. 2013-256729, filed Dec. 12, 2013 is expressly incorporated by reference herein.

What is claimed is:

1. A recording apparatus comprising:

a recording head that performs recording on a recording medium;

a medium support member that is disposed at a position where the medium support member can face the recording head, support the recording medium, and has both ends of the medium support member in a direction orthogonal to a transport direction of the recording medium; and a reinforcing member that is attached to the both ends of the medium support member and has a greater rigidity than the medium support member, wherein the reinforcing member has a smaller thermal expansion coefficient than the medium support member, wherein the medium support member has a groove or a slit which is arranged between the both ends of the medium support member, wherein the reinforcing member has an engage portion to suppress deformation of the medium support member in a vertical direction intersecting the medium support member by thermal expansion of the medium support member.

2. The recording apparatus according to claim 1, wherein the groove or the slit extends along the transport direction of the recording medium and is plurally disposed at an interval in a direction intersecting the transport direction of the recording medium.

3. The recording apparatus according to claim 2, wherein the groove or the slit is formed on at least one side of an upstream side and a downstream side of the transport direction of the recording medium.

4. The recording apparatus according to claim 1, wherein the medium support member includes a plurality of holding units that holds the reinforcing member at intervals in the direction intersecting the transport direction of the recording medium, and the holding unit is disposed to correspond to a position of the groove or the slit.

5. The recording apparatus according to claim 4, wherein the holding unit includes a hook that hooks the engage portion of the reinforcing member in the medium support member.

6. The recording apparatus according to claim 1, wherein the medium support member is formed of a conductive resin.

7. A recording apparatus comprising:

a pair of frames that is provided with an apparatus main body;

a recording head that performs recording on a recording medium;

a medium support member that is disposed at a position where the medium support member can face the recording head, supports the recording medium, and has both ends of the medium support member which is supported to the pair of the frames; and a reinforcing member that is disposed below the medium support member, and has a greater rigidity than the medium support member, wherein the reinforcing member has a smaller thermal expansion coefficient than the medium support member, wherein the medium support member has a groove or a slit which is arranged between the both ends of the medium support member, wherein the reinforcing member has an engage portion to suppress deformation of the medium support member in a vertical direction intersecting the medium support member by thermal expansion.

8. The recording apparatus according to claim 7, wherein the groove or the slit extends along a transport direction of the recording medium and is plurally disposed at an interval in a direction intersecting the transport direction of the recording medium.

9. The recording apparatus according to claim 7, wherein the groove or the slit is formed on at least one side of an upstream side and a downstream side of the transport direction of the recording medium.

10. The recording apparatus according to claim 7, wherein the medium support member includes a plurality of holding units that holds the reinforcing member at intervals in the direction intersecting the transport direction of the recording medium, and the holding unit is disposed to correspond to a position of the groove or the slit.

11. The recording apparatus according to claim 7, wherein the holding unit includes a hook that hooks the engage portion of the reinforcing member in the medium support member.

12. A recording apparatus comprising:

a pair of frames that is provided with an apparatus main body;

a recording head that performs recording on a recording medium;

a medium support member that is disposed at a position where the medium support member can face the recording head, and supports the recording medium, and has both ends of the medium support member which is supported to the pair of the frames; and a reinforcing member that is displaced below the medium support member, and has a greater rigidity than the medium support member, wherein the reinforcing member has a smaller thermal expansion coefficient than the medium support member, wherein the medium support member has a groove or a slit which is arranged between the both ends of the medium support member, the groove or the slit extends along a transport direction, wherein the reinforcing member has a hole, wherein the medium support member has a hook which engages the hole of the reinforcing member, wherein the hook of the medium support member moves within the hole when the medium support member is deformed by thermal expansion.

13. The recording apparatus according to claim 12, wherein the groove or the slit that extends along the transport direction are plurally disposed at an interval in a direction intersecting the transport direction.

14. The recording apparatus according to claim 12 wherein the groove or the slit is formed on at least one side of an upstream side and a downstream side of the transport direction.

15. The recording apparatus according to claim 12, wherein the hole of the reinforcing member is disposed to correspond to a position of the groove or the slit.

* * * * *